US006374072B1

(12) United States Patent
Wiedemer

(10) Patent No.: US 6,374,072 B1
(45) Date of Patent: Apr. 16, 2002

(54) ELECTROGRAPHIC PRINTER DEVICE WITH ADDITIONAL COLOR PRINTING UNIT AS WELL AS METHOD THEREFOR

(75) Inventor: Manfred Wiedemer, Ismaning (DE)

(73) Assignee: Oće Printing Systems GmbH, Poing (DE)

( * ) Notice: Subject to any disclaimer, the term of this patent is extended or adjusted under 35 U.S.C. 154(b) by 0 days.

(21) Appl. No.: 09/643,268

(22) Filed: Aug. 22, 2000

(30) Foreign Application Priority Data

Aug. 24, 1999 (DE) ..... 199 40 037

(51) Int. Cl.[7] ..... G03G 21/00
(52) U.S. Cl. ..... 399/223; 399/231
(58) Field of Search ..... 399/223, 231, 399/232, 298

(56) References Cited

U.S. PATENT DOCUMENTS 5,241,357 A * 8/1993 Iwata ..... 399/231

FOREIGN PATENT DOCUMENTS

| | | |
|---|---|---|
| DE | 29 44 986 | 6/1980 |
| DE | 38 02 227 | 8/1988 |
| JP | 07325456 | 12/1995 |
| JP | 08076548 A | 3/1996 |
| WO | WO 96/02871 | 2/1996 |
| WO | WO 98/27466 | 6/1998 |
| WO | WO 98/27472 | 6/1998 |
| WO | 196 52 861 | 6/1998 |
| WO | WO 98/57233 | 12/1998 |

* cited by examiner

*Primary Examiner*—Quana M. Grainger
(74) *Attorney, Agent, or Firm*—Schiff Hardin & Waite

(57) ABSTRACT

An electrographic printer device contains a first printing unit and a second printing unit, each printing unit containing at least one developer unit. A second developer unit in the second printing unit employs a coating method that works without contact, for example the toner spraying method, and inserts colored toner images into toner-free regions on the photoconductor drum.

22 Claims, 3 Drawing Sheets

26
24
13
10
22
32
20
31
18
P1
12
14
ß
Δn SUB-LINES
30
28
CONTROL UNIT
1. LED-ZG
34
16
CONTROL
UNIT
2. LED-
ZG
42
38
40
BW
BW
OR
COLOR
?
COLOR
FIFO
n SUB-LINES
RASTER DATA
(BW + COLOR)
46
44
45
RASTER MODULE
CONTROLLER
36
INFOR-
MATION
STORE
FOR FDE

ELECTROGRAPHIC PRINTER DEVICE WITH ADDITIONAL COLOR PRINTING UNIT AS WELL AS METHOD THEREFOR

BACKGROUND OF THE INVENTION

The invention is directed to an electrographic printer device, particularly a printer or copier, having a first printing unit that applies a first toner image onto an intermediate carrier, and having a second printing unit following the first printing unit in a running direction of the intermediate carrier that applies a second toner image onto the intermediate carrier. Each printing unit contains at least one developer unit. The invention is also directed to a method for printing upon employment of the electrographic printer device.

In many applications, it is necessary to emphasize specific print information within black-and-white print information in color. Examples of this are invoices, forms, address tapes, company logos, etc. A printing carrier with a plurality of colors is already standard with the assistance of ink jet printers. Such printers, however, have a low throughput and are limited to small print jobs. Offset printers can be utilized given larger printing volumes. The combination of successively connected printers that respectively produce one color print has the disadvantage of higher apparatus expense and of the complicated control of both the printing operations as well as the transport.

WO 98/27466 of the same assignee discloses a printer device of the type initially cited. The printer device disclosed therein contains two printing units with a respective developer station that apply toner images onto a single photoconductor band. When the photoconductor band runs, a first character generator generates a first latent charge image that is inked with toner by a first developer station, as a result whereof a toner image is produced. Subsequently, a second character generator generates a second latent charge image on the developed, first charge image by superimposition, said second latent charge image being developed by a second developer station. A second toner image is thus superimposed on the first toner image on the photoconductor band. The resulting toner image is then transferred onto a paper web at a transfer printing location. A two-color toner image can be printed with high printing speed at the transfer location in this way. The charge images generated on the photoconductor band by the two printing units must geometrically exactly fit one another. Further, the toner materials employed in the two developer units must adhere to predetermined, strict material limits with respect to the latent images and must be finely matched to one another. The techniques required for this purpose are technically involved and limit a flexible use.

SUMMARY OF THE INVENTION

An object of the invention is to specify an electrographic printer device and a method that allow a simultaneous printing with a plurality of toner images, that are simply constructed and flexibly employable.

According to the method and system of the invention for electrographic printing in a printer or copier, a first printing unit applies a first toner image onto an intermediate carrier. With a second printing unit following the first printing unit in a running direction of the intermediate carrier, the second toner image is applied onto the intermediate carrier. The first printing unit has at least a first developer unit and the second printing unit has at least a second developer unit. With the second developer unit of the second printing unit, a toner is applied onto the intermediate carrier upon employment of a coating method that works without contact. The second toner image is inserted on the intermediate carrier in toner-free regions that are not covered by the first toner image.

According to the invention, the second printing unit has a second developer unit that applies toner onto the intermediate carrier, for example a photoconductor drum or a photoconductor band, upon employment of a coating method that works in non-contacting fashion. Given such a method that works without contact, no color entrainment of the toner image produced by the first printing unit occurs since contact with the first toner image is avoided. Such a color entrainment would substantially reduce the printing quality. The second toner image is inserted on the intermediate carrier in toner-free regions that are not covered by the first toner image. As a result thereof, a superimposition of charge images, which would require a high expense on the part of the intermediate carrier and on the part of the generation of the charge image, is not necessary. Accordingly, the electrographic printer device of the invention is simply constructed.

The coating method of the second developer unit is independent of the coating method of the first developer unit, as a result whereof a highly flexible employment is achieved. For example, it is possible to structurally modify existing electrographic printer devices having only a single printing unit such that a second printing unit is additionally installed, this then applying the coating method that works in non-contacting fashion. The invention thus makes it possible to emphasize company logos, signatures or other image parts with a second toner image, whereby the same units as for the first printing unit that produces the principal printing can be employed to a considerable extent.

According to a preferred exemplary embodiment, the transfer printing from the intermediate carrier onto an ultimate carrier and the fixing of the two toner images occurs in common. In this way, the required hardware expense remains low and existing units can be multiply employed.

According to another preferred exemplary embodiment, the second developer unit contains a developer drum that is coated with toner, whereby a developing gap is present between the intermediate carrier and the developer drum, and toner is transferred onto the surface of the intermediate carrier from the developer drum as a result of an electrical force field between developer drum and intermediate carrier. Such a coating method that works without contact is disclosed by WO 98/27472 of the same assignee and is referred to as a "toner jump" method. In this method, a latent charge image whose charge potential fluctuates dependent on image structures is present on the intermediate carrier. An electrical field arises in the region of the developing gap, this causing the toner particles to jump from the surface layer of the developer drum onto the intermediate carrier and agglomerate thereto. Since the toner particles only overcome the developing gap when a corresponding charge potential is present on the part of the intermediate carrier, the first toner image is not negatively influenced and no toner materials are entrained.

A toner spraying method is preferably employed as a coating method working without contact, whereby a spray stream of toner-air mixture that is sprayed onto the developer drum is produced. Such a toner spraying method is disclosed by WO 98/57233 of the same assignee. This document is hereby incorporated by reference into the disclosure of the present application. Given a toner spraying method, a developer unit contains a toner spraying unit that generates the stream of toner-air mix. The toner particles having a defined toner charge agglomerate on the surface of the developer drum. From this developer drum, toner particles are transferred onto the intermediate carrier via a developer gap dependent on charge image, and the charge image is inked. This toner spraying method thus works in non-contacting fashion and assures that a first toner image that is already potentially present is not harmed and toner material is not entrained.

An exemplary embodiment of the invention is described below on the basis of the drawings.

DESCRIPTION OF THE PREFERRED EMBODIMENTS

Figure 1:
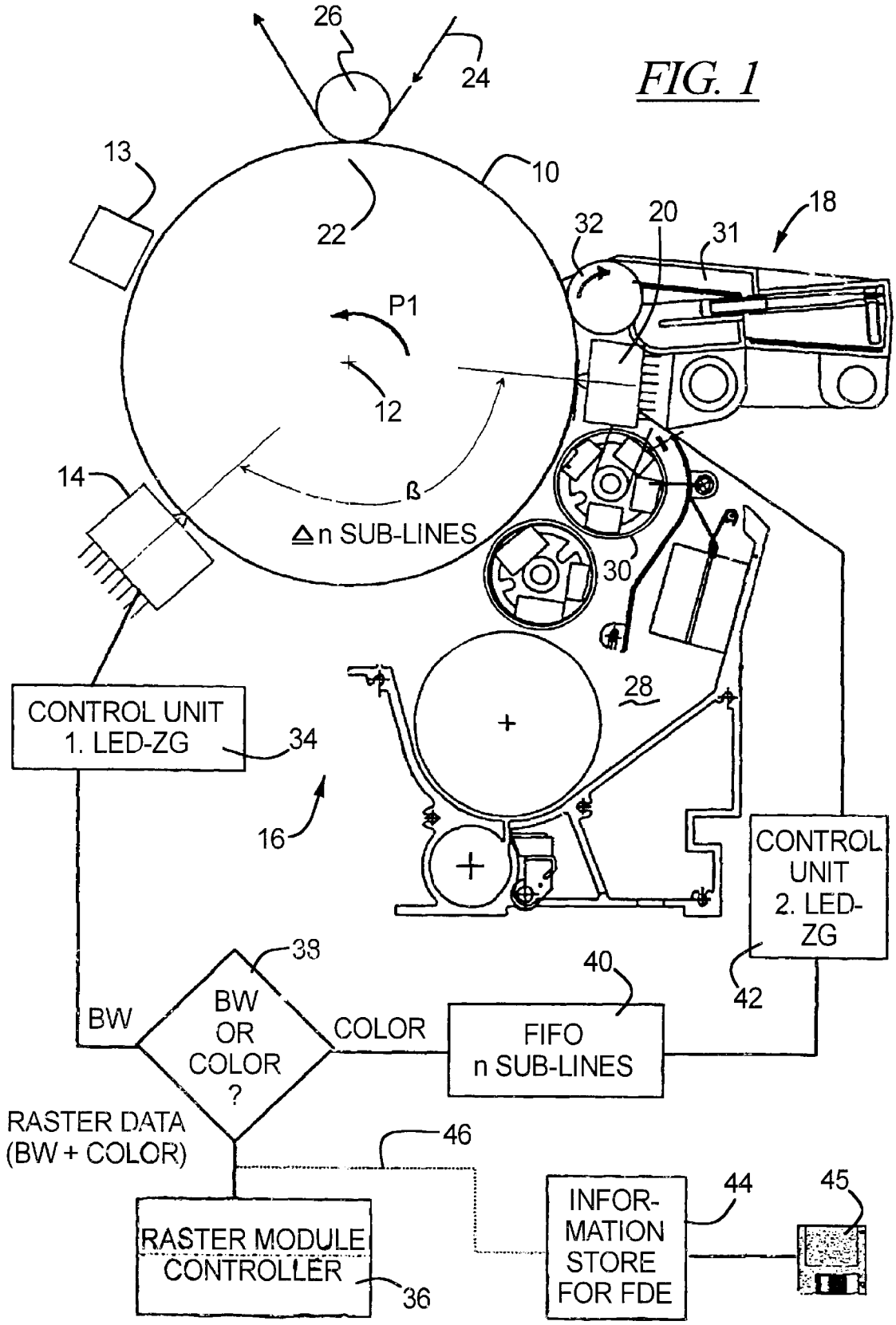
FIG. 1 is a schematic arrangement of a printer device having two printing units.

FIG. 1 schematically shows a printer in terms of its critical components. A photoconductor drum 10 rotates around the rotational axis 12 in the arrow direction P1. A charging unit 13 and a first printing unit 16 that contains a first illumination unit 14 that is preferably designed as a LED character generator are arranged as viewed in the circumferential direction of the photoconductor drum 10. A second printing unit 18 is also provided, this containing a second illumination unit that is likewise preferably designed as a LED character generator. The two printing units 16, 18 transfer toner images having a different color onto the surface of the photoconductor drum 10. The toner images are transfer-printed onto a carrier material 24, generally paper, at a transfer printing location 22 upon employment of a counter-pressure drum 26. Subsequently, the toner images situated on the carrier material 24 are fixed in common in a fixing station (not shown).

The first printing unit 16 contains a developer unit 28 that works according to the two-component magnetic brush method. In this method, a mixture of toner particles and ferromagnetic carrier particles that triboelectrically charge one another is employed. In a magnetic field, the soft-magnetic carrier particles form a brush structure on an applicator drum 30. This brush structure is in direct contact with the charge image on the surface of the photoconductor drum 10. The charged toner particles are deposited from the brush structure on the surface of the charge image-carrying photoconductor drum 10 according to the distribution of the electrical field and the toner charge.

A one-component magnetic brush method can also be employed as an alternative to the two-component magnetic brush method. In this method, the ferromagnetic carrier particles are foregone and the toner particles themselves contain a ferromagnetic component. The toner particles likewise form a brush structure in the magnetic field, charged toner particles being respectively situated at the ends thereof. In this case, too, the brush structure is in direct contact with the surface of the photoconductor drum.

The second printing unit 18 following the first printing unit 16 contains a developer unit 31 that works according to a non-contacting coating method, for example according to the toner spraying method—which is explained in greater detail latter—or according to the toner jump method.

What is critical given this second printing unit 18 is that a developing gap is present between an application drum 32 and the surface of the photoconductor drum 10, this assuring that the first toner image that is already present and that was produced by the first printing unit is not smeared and that no color entrainment of the toner particles thus occurs. The second printing unit 18 contains an independent illumination unit 20 that is combined with the developer unit 21 to form a structural unit, the printing unit 18. As a result thereof, it is possible to subsequently install this structural unit as an auxiliary device in printers having only a single, first printing unit or to retrofit a corresponding printer.

Let it be mentioned in this context that it is also possible to divide the second printer unit 18 into a plurality of modules that respectively contain a developer unit and an illumination unit, whereby the modules are arranged transversely relative to the running direction of the photoconductor drum 10. For example, such an arrangement makes it possible to ink two paper webs lying side-by-side that are transported along the circumference of the photoconductor drum 10 with toner images, whereby each module inks one paper web with toner images. In the same way, the first printing unit 16 can also be divided into a plurality of modules that are arranged transversely relative to the running direction of the photoconductor drum 10.

During operation, the second printing unit 18 inserts second toner images on the surface of the photoconductor drum 10 in toner-free regions that are not covered by the first toner image that the first printing unit 16 generates. In general, the first printing unit 16 performs the basic printing work with black-and-white image patterns and is constructed correspondingly to have high-performance. The second printing unit 18 generates image portions emphasized in color, for example company logos, signatures, address labels or the like.

The charging unit 13 charges the charge-sensitive and light-sensitive surface of the photoconductor drum 10 with a corona discharge, for example to a positive voltage of 900 volts. The first illumination unit 14 discharges image portions that are to be inked by the first printing unit 16 with the first toner color, for example black. This first illumination unit 14 is digitally electrically driven by a first control unit 34 in order to generate a charge image according to the image pattern of a rastered printing page. This control unit 34 receives its digital information from a raster module 36 via a diplexer 38. On the basis of control characters, this diplexer 38 selects whether black-and-white image portions SW or image portions to be emphasized with color are to be printed. When black-and-white image portions are to be printed, then the diplexer 38, which is generally realized in software terms, forwards the information to the first control unit 34. When image portions to be emphasized in color are to be printed, then the information of the raster module 36 are stored in a FIFO memory 40, which outputs the information—delayed by n sub-lines—to the second control unit 42, which drives the second illumination unit 20. The plurality of n sub-lines corresponds to the angular spacing between first illumination unit 14 and second illumination unit 20. In this way, the second illumination unit generates an image pattern charge image by partial discharge at locations that had not been illuminated by the first illumination unit but were previously charged by the charging unit 13. The second illumination unit 20 can thus only illuminate locations that have not already been illuminated by the first illumination unit 14 and inked by the first developer unit 28.

The charge image generated by the second illumination unit 20 is inked with a second, chromatic toner color with the assistance of the second developer unit 31.

According to one version, the charging can also occur dependent on the toner images to be applied. This version is characterized in that the intermediate carrier 10 is charged with a first bias for printing with the first printing unit 16, that the intermediate carrier is charged with a second bias for the printing with the second printing unit, and that the two biases differ, preferably by 50 to 100 volts.

As an alternative, a separate information store 44 can be provided that keeps image data for the illumination unit 20, i.e. for the second printing unit 18, on hand separately and receives this image data from, for example, a storage medium 45, for example a diskette. The image data are then forwarded to the diplexer 38 according to the dotted line 46. As warranted, the FIFO memory 40 can be omitted given this alternative.

A photoconductor drum 10 is employed as an intermediate carrier in the present case. Of course, a photoconductor band can also be provided instead of the photoconductor 10.

The second printing unit 18 directly follows the first printing unit 16, as a result whereof a very compact structure is achieved. In this way, the loss of carrier material 24 in case of error is minimal.

Figure 2:
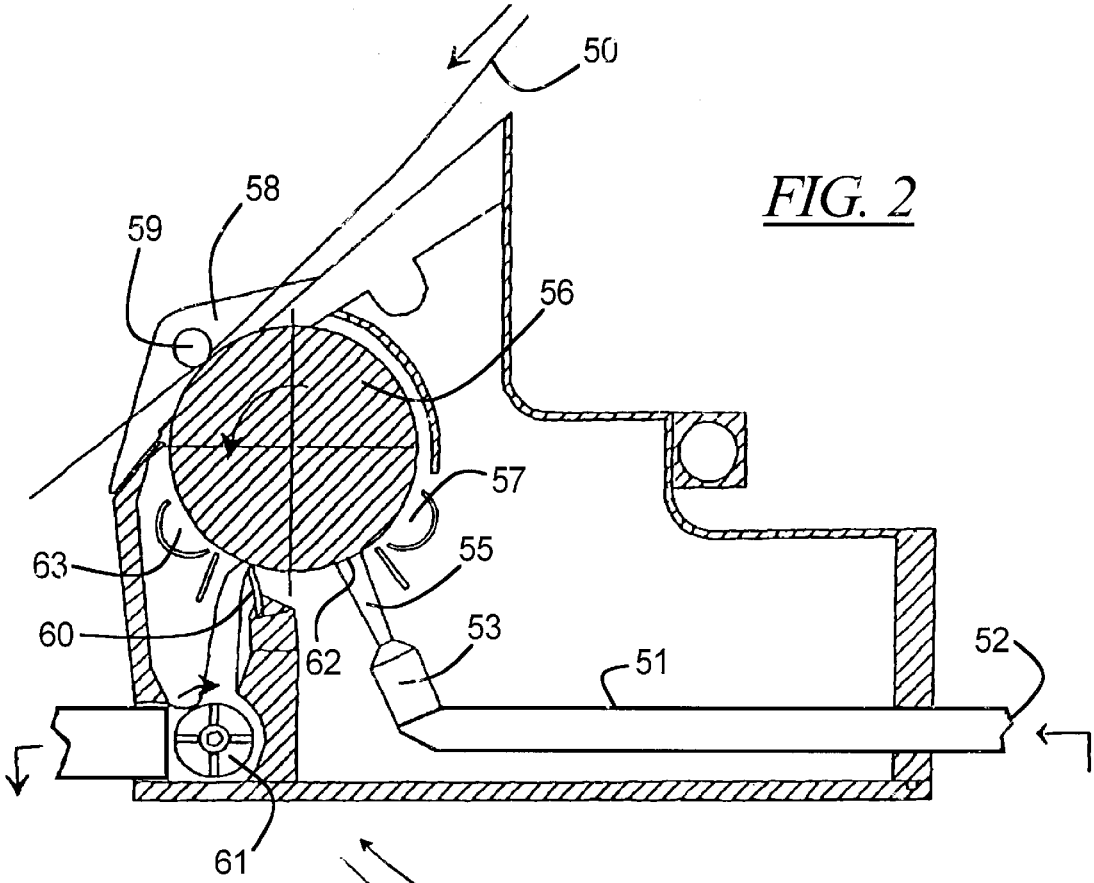
FIG. 2 is a printing unit that works according to the toner spraying method.

FIG. 2 shows a developer unit that works according to the toner spraying method. The developer unit contains a toner sprayer unit 51 with a delivery tube 52 having a nozzle 53 that comprises an electrode in the form of a corona charging means in its orifice region. The toner sprayer unit 51 produces a mixed stream of a toner-air mixture that contains toner particles having a defined toner charge. For this purpose, toner is dispersed in air in the pump system of the toner sprayer unit and this mixed stream is supplied via the delivery tube 52 to the nozzle 53, and a directed spray jet is generated in this way. This usually occurs in that fluidized toner from a fluid bed is suctioned in with a Venturi nozzle via an acceleration unit, is uniformly distributed in a transport airstream and is accelerated to high speed. Dependent on the toner employed, the electrode is charged with a voltage of +5 or −5 KV or more and sprays charges onto the toner particles, which then have a toner charge of, preferably, ±10 $\mu$C/g through ±30 $\mu$C/g. The electrode acting as a corona discharge unit can be arranged in the mixed stream 55 or in the immediate proximity of the mixed stream 55. It charges the toner particles in defined fashion.

Instead of the charging with the assistance of the electrode for a corona charging, it is also possible to triboelectrically charge the toner particles in a known way.

An application element 56 is arranged in the region of the mixed stream 55. In the illustrated case, it is composed of a metal drum having a partially conductive surface of, for example, amorphous carbon so that the distance between the toner charge and its mirror charge is large enough to enable the adhesion of the toner to the application element 56 and small enough in order to prevent the required stripping field from becoming too great, since the charging of the photoconductor is limited. It is also possible to employ a continuous band instead of a drum-shaped application element 56.

The application element 56 is motor-driven in arrow direction. A corona device 57 is arranged at the application element 56, this serving the purpose of charging a toner layer applied on the application element 56 with the assistance of the toner sprayer unit with an ion current and of thus homogenizing the charge in the toner layer. The surface of the application element 56 is located at a close distance from the carrier medium 50, for example the surface of the photoconductor drum 10 or of a photoconductor band, namely at a distance that can be less than 100 $\mu$m, whereby the gap defines the actual developer region or, respectively, transfer region 58.

In order to assure this distance, the carrier medium 50, the photoconductor band in this case, is guided by a spacer drum 59 in this region. A stripper element 60 of elastic material is arranged following the transfer region 58 in the moving direction, this serving the purpose of stripping residual toner from the application element 56 and supplying it to a toner reservoir via a conveyor unit 61. The stripper element 60 is preceded by a further corona unit 63.

The function of the developer unit shall now be explained in greater detail below on the basis of FIG. 2. First, a mixed stream 55 in the form of a spray jet of charged toner particles in a transport airstream is produced with the assistance of the toner sprayer unit 51. In the illustrated reverse development method, the application element 56 lies at an application potential of −450 V. As a result of these voltage conditions in conjunction with the toner charge, the toner particles agglomerate to the surface of the application element 56 in an acceptance region 62. The agglomeration of the toner particles is thereby supported by their kinetics (pulse). The kinetics are in turn dependent on the velocity of the transport airstream that carries the toner particles. They form a uniform, homogeneous layer thereat having a layer thickness of approximately 1–3 toner layers or more. This layer is charged with an ion current with the assistance of corona charging unit 57 in order to thereby homogenize the charge in the layer.

Due to the continued movement of the application element 56, the acceptance region 62 with the toner layer proceeds into the transfer region 58 with the developing gap, where the toner particles, dependent on the charge image, jump from the application element 56 onto the charge image of the photoconductor 50 across the developing gap having a width of approximately 100 $\mu$m or less and ink said charge image. In order to facilitate this jump, an auxiliary transfer voltage of, preferably, 200–500 V can be adjacent between the carrier medium 50 and the application element 56 in the transfer region 58. It is activated during the entire development duration.

Since all toner particles do not jump onto the carrier medium when developing the charge images on the carrier medium 50, residual toner particles must be removed from the application element 56 over the further course. For this purpose, they are first exposed to a further corona charging unit 63 that loosens the retaining force of the toner particles on the surface of the application element 56. Subsequently, they are stripped off with the assistance of the stripper element 60 and re-supplied to the toner reservoir (not shown) via the toner conveyor unit 61 or, respectively, are cleaned via a recycling system and are then supplied to the toner reservoir. The application element 56 freed of residual toner in this way is then sprayed anew with toner in the acceptance region 62. This process sequences continuously.

The aforementioned developer unit is disclosed in greater detail in WO 98/57233, whose content is incorporated by reference into the disclosure of the present application.

As an alternative, a toner jump coating method can also be utilized, whereby the toner particles jump over a developing gap between an application drum and the surface of the photoconductor as a result of the influence of an electrical force field. In this coating method working without contact, too, the first toner images are not smeared and no color entrainment occurs. Such a toner jump coating method is disclosed by DE 196 52 861 and WO 98/27472 of the same assignee. Said documents are herewith incorporated by reference into the disclosure of the present patent application.

Figure 3:
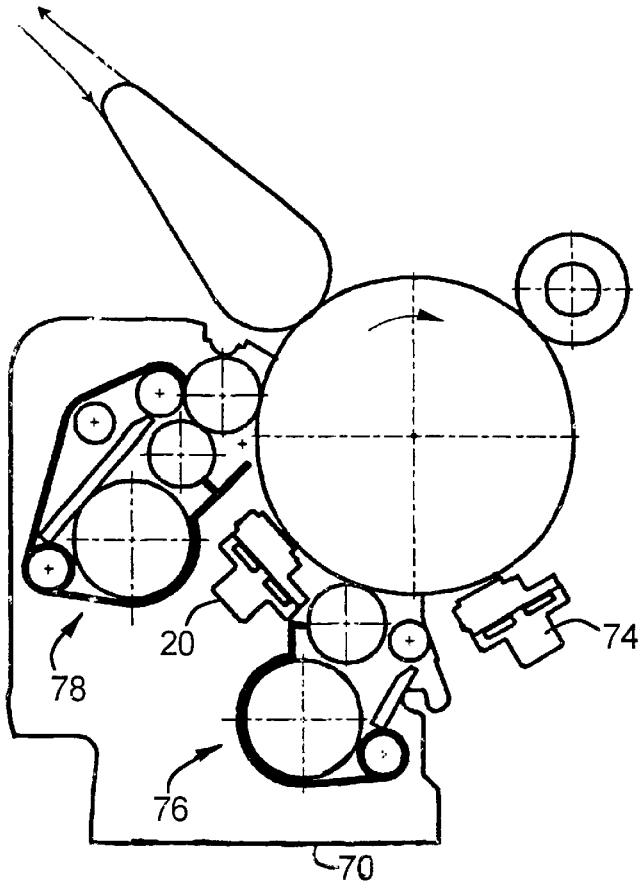
FIG. 3 shows the arrangement of two printing units to form a replaceable unit.

FIG. 3 schematically shows an exemplary embodiment wherein the two printing units 16 and 18 are united to form a single structural unit 70. Such a structural unit 70 can be releasably arranged in a printer in order to design it to be easily replaceable or in order to simplify the maintenance of the printing units 16, 18 as well as of other units.

Figure 4:
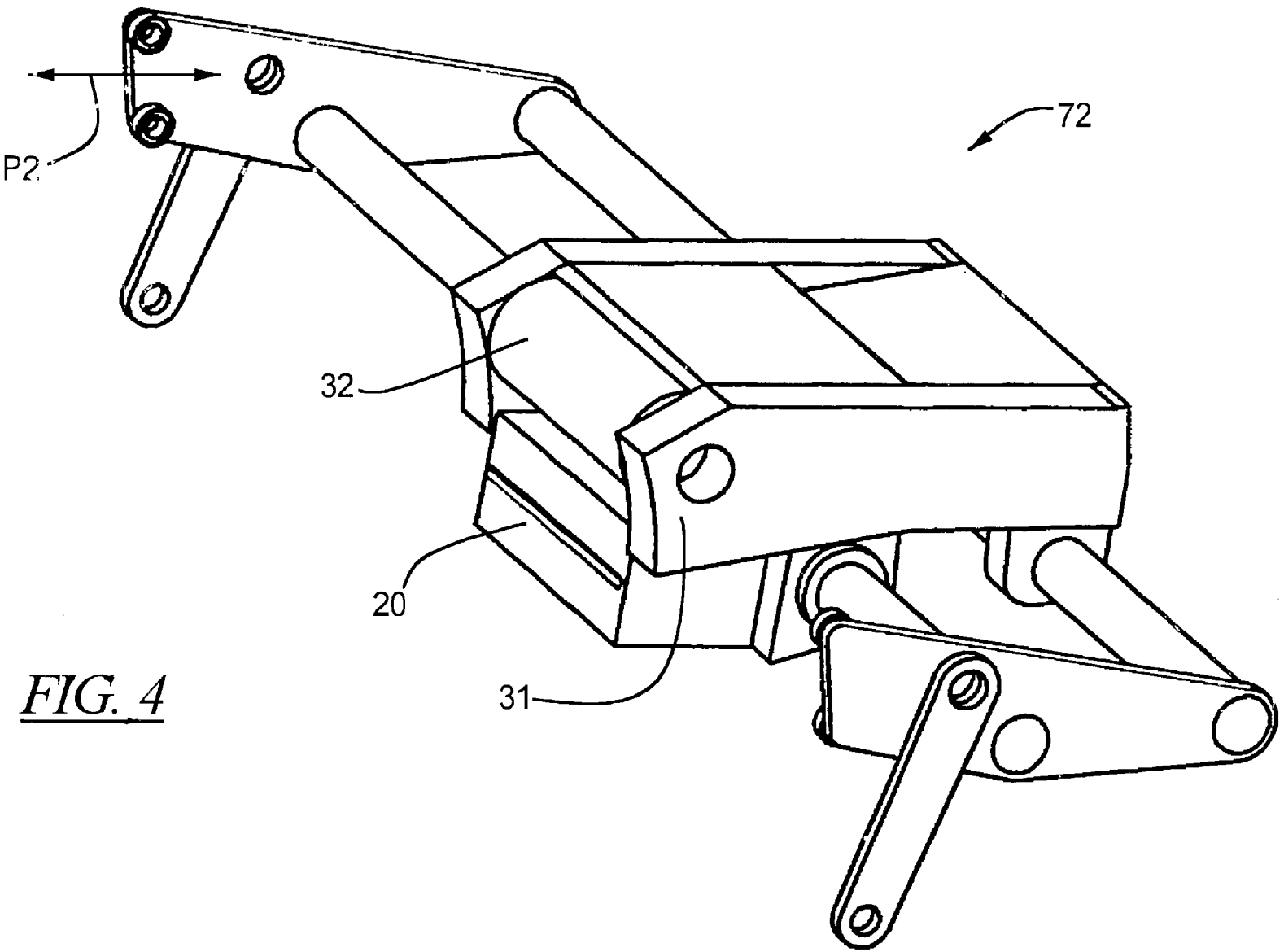
FIG. 4 illustrates a unit composed of the second printing unit and an illumination unit.

FIG. 4 shows an example of a second printing unit 18, whereby the developer unit 31 and the illumination unit 20 are combined to form a single unit 72. This unit 72 is suspended in the printer displaceable in arrow direction P2 in order to produce the required spacing between the illumination unit 20 and the surface of the photoconductor. This spacing can be acquired, for example, by a detector system that generates an electrical signal, whereupon a positioning element generates a movement in arrow direction P2 in order to set the required spacing.

Although various minor modifications might be suggested by those skilled in the art, it should be understood that my wish to embody within the scope of the patent warranted hereon all such modifications as reasonably and properly come with the scope of my contribution to the art.

I claim as my invention:

1. An electrographic printer or copier device, comprising:

a first printing unit having at least a first developer unit and that applies a first toner image onto an intermediate carrier;

a second printing unit having at least a second developer unit and that follows the first printing unit in a running direction of the intermediate carrier and applies a second toner image onto the intermediate carrier;

the second developer unit of the second printing unit applying toner onto the intermediate carrier upon employment of a coating method that works without contact;

the second printing unit inserting the second toner image inserted on the intermediate carrier in toner-free regions that are not covered by the first toner image; and the second printing unit containing an independent illumination unit.

2. The electrographic printer device according to claim 1, wherein the illumination unit is arranged immediately following the first developer unit in the running direction of the intermediate carrier.

3. The electrographic printer device according to claim 1 wherein the illumination unit is designed as a LED illumination unit.

4. The electrographic printer device according to claim 1 wherein the second developer unit and the corresponding illumination unit are combined to form a single unit.

5. The electrographic printer device according to claim 1 wherein the first printing unit and the second printing unit generate toner images of different toner colors.

6. The electrographic printer device according to claim 1 wherein the intermediate carrier is charged with a first bias for printing with the first printing unit, the intermediate carrier is charged with a second bias for printing with the second printing unit, and the two biases differ by 50 to 100 volts.

7. The electrographic printer device according to claim 1 wherein the second developer unit contains a developer drum that is coated with toner; a developing gap is present between the intermediate carrier and the developer drum; and toner, overcoming the developing gap, is transferred from the developer drum as a result of an electrical force field between the developer drum and the intermediate carrier.

8. The electrographic printer device according to claim 1 wherein a toner spraying method is utilized as a coating method working without contact, so that a toner-air mixture sprayed onto the developer drum is produced.

9. The electrographic printer device according to claim 1 wherein the first developer unit of the first printing unit is designed as a two-component magnetic brush developer unit.

10. The electrographic printer device according to claim 1 wherein the first developer unit of the first printing unit is designed as a one-component magnetic brush developer unit.

11. An electrographic printer or copier device, comprising:

a first printing unit having at least a first developer unit and that applies a first toner image onto an intermediate carrier;

a second printing unit having at least a second developer unit and that follows the first printing unit in a running direction of the intermediate carrier and applies a second toner image onto the intermediate carrier;

the second developer unit of the second printing unit applying toner onto the intermediate carrier upon employment of a coating method that works without contact;

the second printing unit inserting the second toner image inserted on the intermediate carrier in toner-free regions that are not covered by the first toner image;

the second printing unit being divided into a plurality of modules that respectively contain a developer unit and an illumination unit; and the modules being arranged transversely relative to the running direction of the intermediate carrier.

12. An electrographic printer or copier device, comprising:

a first printing unit having at least a first developer unit and that applies a first toner image onto an intermediate carrier;

a second printing unit having at least a second developer unit and that follows the first printing unit in a running direction of the intermediate carrier and applies a second toner image onto the intermediate carrier;

the second developer unit of the second printing unit applying toner onto the intermediate carrier upon employment of a coating method that works without contact;

the second printing unit inserting the second toner image inserted on the intermediate carrier in toner-free regions that are not covered by the first toner image; and the first printing unit being divided into a plurality of modules that are arranged transversely relative to the running direction of the intermediate carrier.

13. A method for electrographic printing for employment in a printer or copier, comprising the steps of:

providing a first printing unit with the first developer unit and providing a second printing unit with a second developer unit, the second printing unit following the first printing unit in a running direction of an intermediate carrier;

with the first printing unit, applying a first toner image onto the intermediate carrier; and with the second printing unit, applying a second toner image onto the intermediate carrier, the second developer unit of the second printing unit applying toner onto the intermediate carrier by use of a coating method that works without contact, and wherein the second toner image is inserted on the intermediate carrier in toner-free regions that are not covered by the first toner image.

14. A method for electrographic printing for employment in a printer or copier, comprising the steps of:

providing a first printing unit with the first developer unit and providing a second printing unit with a second developer unit, the second printing unit following the first printing unit in a running direction of an intermediate carrier;

with the first printing unit, applying a first toner image onto the intermediate carrier;

with the second printing unit, applying a second toner image onto the intermediate carrier, the second developer unit of the second printing unit applying toner onto the intermediate carrier by use of a coating method that works without contact, and wherein the second toner image is inserted on the intermediate carrier in toner-free regions that are not covered by the first toner image; and the second printing unit containing an independent illumination unit.

15. The method for electrographic printing according to claim 14 wherein a toner spraying method is utilized as the coating method working without contact, whereby a toner-air mixture sprayed onto the developer drum being produced.

16. The method for electrographic printing according to claim 14 wherein the second developer unit and the corresponding illumination unit are combined to form a single unit.

17. The method for electrographic printing according to claim 14 wherein the first printing unit and the second printing unit generate toner images of different toner colors.

18. The method for electrographic printing according to claim 14 wherein the intermediate carrier is charged with a first bias for printing with the first printing unit, the intermediate carrier is charged with a second bias for printing with the second printing unit, and the two biases differ by 50 to 100 volts.

19. The method for electrographic printing according to claim 14 wherein the second developer unit contains a developer drum that is coated with toner, a developing gap is present between the intermediate carrier and the developer drum, and toner, overcoming the developing gap, is transferred from the developer drum as a result of an electrical force field between developer drum and intermediate carrier.

20. The method for electrographic printing according to claim 14 wherein a toner spraying method is utilized as the coating method working without contact, whereby a toner-air mixture sprayed onto the developer drum being produced.

21. The method for electrographic printing according to claim 14 wherein the first developer unit of the first printing unit is designed as a two-component magnetic brush developer unit.

22. The method for electrographic printing according to claim 14 wherein the first developer unit of the first printing unit is designed as a one-component magnetic brush developer unit.

* * * * *